United States Patent [19]

Heyden et al.

[11] 3,971,626

[45] July 27, 1976

[54] FAT-LIQUORING AGENT FOR WATERPROOFING LEATHER AND SKINS

[75] Inventors: Rudi Heyden, Hochdahl-Millrath; Adolf Asbeck, Dusseldorf-Holthausen, both of Germany

[73] Assignee: Henkel & Cie G.m.b.H., Dusseldorf, Germany

[22] Filed: Oct. 29, 1974

[21] Appl. No.: 518,247

[30] Foreign Application Priority Data

Nov. 3, 1973 Germany ..... 2355025

[52] U.S. Cl. ..... 8/94.23; 106/2; 106/287 R; 252/8.57; 428/473

[51] Int. Cl.[2] ..... C14C 9/02

[58] Field of Search ..... 106/2, 287; 252/8.57, 252/6; 8/94.21–94.23; 428/473; 427/389

[56] References Cited

UNITED STATES PATENTS

| | | | |
|---|---|---|---|
| 2,672,455 | 3/1954 | Carlyle | 8/94.21 |
| 2,974,000 | 3/1961 | Retzsclt | 8/94.23 |
| 3,276,891 | 10/1966 | Heyden | 428/473 |
| 3,749,669 | 7/1973 | Luvisi | 252/8.57 |

FOREIGN PATENTS OR APPLICATIONS

| | | |
|---|---|---|
| 1,166,411 | 3/1964 | Germany |

*Primary Examiner*—Theodore Morris
*Attorney, Agent, or Firm*—Hammond & Littell

[57] ABSTRACT

A process for preparing waterproof leathers by fat-liquoring with an aqueous liquor containing esters of citric acid with higher fatty alcohols which are used as the impregnating agent, characterized in that the fat-liquoring agent contains a mixture emulsified in water which consists of (A) an acid ester of citric acid with a higher fatty alcohol having chain lengths of 12 to 22 carbon atoms and (B) an organic alcohol solvent for the citric acid ester which is totally or partially soluble in water and which have a boiling point above 100°C.

13 Claims, No Drawings

FAT-LIQUORING AGENT FOR WATERPROOFING LEATHER AND SKINS

THE PRIOR ART

It is known in the prior art that good dynamic waterproofness can be obtained by the impregnation of dried leathers with partial or acid citric acid esters of fatty alcohols. However, the practical application of these esters is made very difficult, since the use of large amounts of organic solvents, for example, chlorinated hydrocarbons or benzine, becomes necessary. The use of such solvents not only requires appreciable safety measures, but also easily results in deposits on, or discolorations of, the impregnated leathers. This is because the solvents on the surface evaporate and thereby remove a portion of the dissolved dyestuffs and tanning agents from the surface. Moreover, the necessary drying of the leathers before the impregnation requires an additional operating step, as well as causing considerably increased costs.

Therefore, attempts have been made in the prior art to use the water-soluble salts of the respective citric acid esters in an aqueous liquor. However, this process does not readily lead to useful results. For example, it may happen that the neutralized water-soluble citric acid esters will partially precipitate upon the surface of chrome tanned leather because of the acid reaction. Such impregnated leathers when dried become hard and tinny. They also possess an unsatisfactory waterproofness. A neutralization of the chrome tanned leathers over their total cross-section might facilitate the penetration of the impregnating agent. However this neutralization cannot be carried out under practical conditions because this procedure likewise impairs the quality of the leathers.

OBJECTS OF THE INVENTION

It is an object of the present invention to provide a process for preparing waterproof leathers by fat-liquoring with an aqueous liquor containing esters of citric acid with higher fatty alcohols which are used as the impregnating agent, characterized in that the fat-liquoring agent contains a mixture emulsified in water which consists of (A) an acid ester of citric acid with a higher fatty alcohol having 12 to 22 carbon atoms and (B) an organic solvent for the citric acid ester which is totally or partially soluble in water and which has a boiling point above 100°C.

This and other objects of the invention will become apparent as the description thereof proceeds.

DESCRIPTION OF THE INVENTION

The present invention is directed to a process for preparing waterproof leathers by fat-liquoring with an aqueous liquor containing esters of citric acid with higher fatty alcohols which are used as the impregnating agent, characterized in that the fat-liquoring agent contains a mixture emulsified in water which consists of (A) an acid ester of citric acid with a higher fatty alcohol having 12 to 22 carbon atoms and (B) an organic alcohol solvent for the citric acid ester which is totally or partially soluble in water and which has a boiling point above 100°C.

More particularly the present invention provides an improvement in the process for manufacturing waterproof leathers or skins by fat-liquoring comprising providing leather or skins to be fat-liquored, applying to said leather or skins an effective amount of a waterproofing agent and recovering said waterproof leather or skins;

wherein the improvement consists in utilizing a fat-liquoring aqueous preparation containing, as an impregnating agent, a mixture emulsified in water which consists of (A) an acid ester of citric acid with a fatty alcohol having 12 to 22 carbon atoms, and (B) an organic solvent for said acid ester of citric acid which is totally or partially soluble in water and having a boiling point of over 100°C, the amount of said acid ester of citric acid in said fat-liquoring aqueous preparation being from 3% to 8% by weight of the shaved weight of the leather or skins, and the ratio of component (A) to component (B) is from 9:1 to 1:9, as said waterproofing agent.

The present invention is also directed to a fat-liquoring agent for waterproofing leather or skins consisting of the above-described fat liquoring aqueous preparation.

The process according to the present invention has the advantages of fat-liquoring by means of an aqueous liquor, so that larger amounts of low-boiling organic solvents are avoided as well as avoiding the prior drying of the tanned leather. In contradistinction to the known prior art processes, leathers having a high dynamic water-proofness are prepared, without the prior art difficulties which arise because of surface precipitation of the impregnating agent, and without spot formation on the leather surface, as well as without a disagreeable handle to the leather.

Suitable examples of component (A) are acid esters of citric acid with higher fatty alcohols having 12 to 22 carbon atoms, preferably 12 to 18 carbon atoms. Preferred are the esters of straight-chain unsaturated fatty alcohols, or mixtures of fatty alcohols, for example, citric acid - monooleyl ester or citric acid-mono-alkenyl ester having 12 to 18 carbon atoms in the alcohol. Also preferred are the esters of branched-chain saturated or unsaturated, fatty alcohols such as citric acid-monoisooctadecyl ester, or citric acid - mono-alkyl ester having 12 to 18 carbon atoms in the alkyl.

Suitable examples of component (B) include organic alcohol solvents having a boiling point above 100°C, preferably above 130°C, which are totally or partially miscible with water, and which also dissolve the acid ester of citric acid in any ratio. Examples for such solvents are the alkanediols having 2 to 6 carbon atoms, such as ethanediol, 1,2-propanediol, 1,3-propanediol, 1,3-butanediol, 1,4-butanediol, 1,5-pentanediol, 1,6-hexanediol, 2-methyl-2-propyl-1,3-propanediol and 2-methyl-2,4-pentanediol. In addition, further examples include the corresponding monoalkyl ethers of the above alkanediols with lower alcohols having 1 to 6 carbon atoms, such as alkanols of 1 to 6 carbon atoms for example methanol, ethanol, propanol, isopropanol or butanol. Examples of these monoalkyl ethers of the alkanediols with lower alcohols include glycol monomethyl ether, glycol monoethyl ether, glycol monobutyl ether and 1,2-propanediol monobutyl ether. A further example includes cycloalkylether alcohols having 4 to 6 carbon atoms such as tetrahydrofurfuryl alcohol. Mixtures of the above alcohols may also be used.

The ratio of the amount of component (A) to the amount of component (B) ranges from 9 : 1 to 1 : 9, preferably 1 : 1 to 2 : 1.

The manufacture of the fat-liquoring agent used for the impregnation of the leather is performed in a known manner by stirring a solution of the acid ester of citric acid dissolved in the respective solvent, into water. The emulsification is considerably facilitated if a quantity of ammonia which is not sufficient for the total neutralization of the acid ester of citric acid is added to the aqueous phase before or during the emulsification step. Thus a sufficiently stable fat-liquoring liquor is obtained and which is utilizable, for example, for the fat-liquoring of leathers which have been chrome tanned or tanned with vegetable - synthetic materials. The fat-liquoring liquor contains from 3% to 8% by weight of the acid ester of citric acid, based upon the shaved weight of the leather. For skins, the fat-liquoring agent contains from 3% to 8% by weight of the acid ester of citric acid based upon the dry weight of the skins. The quality of the impregnation effect is also dependent upon the choice of the solvent. The latter not only facilitates the penetration of the acid citric acid ester into the leather but simultaneously increases the softness and pliability of the leather since the solvent, due to its high boiling point does not evaporate during the conventional drying process. The excellent dynamic waterproofness of the leathers or skins fat-liquored according to the invention, is based upon the formation of a viscous water-in-oil emulsion which clogs the pores of the leather upon the entry of water and prevents a deeper penetration of the water. A special advantage of the process and composition according to the invention consists in the formation of an extremely strong bond between the impregnating agent according to the invention and the leather, especially chrome tanned leather. As a proof, and by contrast to the conventional fat-liquoring oils, the impregnating agent can practically not be extracted with dichloromethane according to DIN 53306. "DIN" is an abbreviation for "Deutsche Industrie Norm" which consists of a published series of standardized German testing procedures similar to ASTM.

Another advantage of the invention is that leathers having satisfactory softness and pliability in addition to excellent dynamic waterproofness are obtained. In general, the addition of the usual fatting agents to the fat-liquoring liquor is unnecessary. An aftertreatment with retanning agents, or the like, can be carried out in the usual manner.

The following examples are merely illustrative of the present invention without being limitative in any manner thereof.

EXAMPLE 1

Chrome tanned leather which had been retanned with vegetable - synthetic tanning materials (and which has a splitting resistance of 1.1 mm) was rinsed at 30°C for 20 minutes. Then the leather was neutralized with a 1.0% solution of sodium bicarbonate in 150% liquor at a temperature of 35°C and for a time period of 45 minutes, followed by rinsing at 35°C for 20 minutes.

The thus pretreated leather was drum tumbled in 200% water containing 5.00% citric acid - mono-oleyl ester
3.35% glycol monoethyl ether, and
1.25% ammonia (25%), which treatment was carried out at 50°C for 60 minutes. By "glycol," ethylene glycol is meant. After the liquor had been discharged, the leather was placed in 200% water and then was acidified with 0.5% formic acid and a 2% chrome tanning agent (Chromosal B) was added. The leather was drum tumbled at 40°C for 60 minutes. The leather was placed over horses and dried overnight according to the pasting process.

The leather thus obtained was soft and pliable and possessed an excellent dynamic waterproofness according to the test in the Bally penetrometer. According to this testing procedure, penetration of water occured only after 73 minutes.

EXAMPLE 1 (COMPARISON)

For comparison, a leather which had been pretreated in the same manner as described above in Example 1 was placed in a 200% liquor and drum tumbled with 5.00% citric acid - monooleyl ester and
1.25% ammonia (25%), likewise at 50°C for 60 minutes and was finished as described above in Example 1.

The resulting leather was flat and tinny, and upon testing in the Bally penetrometer, gave the very unsatisfactory water penetration time of 3 minutes.

EXAMPLE 2

Chrome tanned upper leather which had been retanned with vegetable - synthetic tanning materials was neutralized as described above in Example 1, rinsed, and was drum tumbled in 200% water containing 5.00% citric acid-monoalkenyl ester having chain lengths of $C_{12}$ to $C_{18}$
3.35% glycol monoethyl ether, and
1.25% ammonia (25%), which treatment was carried out at 50°C for 60 minutes. The above citric acid ester is based upon the esterification of citric acid with about 1 mol of a technical mixture of higher unsaturated alcohols which is obtained as a residue after the distillation of oleyl alcohol (and which has an acid number of 0.5, an iodine number of 80, and a hydroxyl number of 80 to 100).

The resulting leather was soft and pliable. The Bally penetrometer test gave an excellent water penetration time of 125 minutes.

EXAMPLE 3

Chrome tanned leather which had been retanned with vegetable - synthetic tanning materials (and which had a splitting resistance of 2 mm) was fat-liquored analogous to the procedure described in Example 1, except that the glycol monoethyl ether was replaced with the following solvents listed in Table 1. Also in Table 1 are the solvent boiling point and the resulting value for water penetration time which was obtained when the dynamic water-proofness was determined with the Bally penetrometer.

TABLE 1

| Solvent | b.p.°C | Water Penetration after Minutes |
|---|---|---|
| Tetrahydrofurfuryl Alcohol | 178 | 170 |
| Ethanediol | 197 | 42 |
| 1,2-Propanediol | 188 | 109 |
| 1,4-Butanediol | 235 | 150 |
| 1,5-Pentanediol | 238 | 128 |
| 2-Methyl-2,4-Pentanediol | 199 | 64 |
| Glycol Monomethyl Ether | 125 | 48 |
| Glycol Monobutyl Ether | 171 | 85 |
| 1,2-Propanediol Monobutyl Ether | 174 | 75 |
| Isopropanol (COMPARATIVE) | 82 | 4 |

EXAMPLE 4

Chrome tanned leathers which had been retanned with vegetable-synthetic tanning materials (having a splitting resistance of 2 mm) were fat-liquored analogously to the procedure described in Example 1. Glycol monoethyl ether served as the solvent; and citric acid -monoisooctadecyl ester served as the impregnating agent. When the finished leathers were tested in the Bally penetrometer, a water penetration time of 50 minutes resulted.

EXAMPLE 5

Chrome tanned leather retanned with vegetable - synthetic tanning materials was fat-liquored with a mixture of citric acid - monooleyl ester and glycol monoethyl ether analagously to the procedure described in Example 1. For comparison, a corresponding chrome tanned leather sample was fat-liquored with a commercial sulfated sperm oil, where likewise 5% of pure fatty compound was used, based on the shaved weight of the leather. After the leather had been finished, the samples were cut into pieces, and in usual manner were extracted with dichloromethane according to DIN 53306 for the determination of the extractable fat material. Based on the leather, the following quantities of extract were obtained:

| | |
|---|---|
| Leather Impregnated according to Example 1 | 1.5% Extract |
| Leather Fat-Liquored with Sulfated Sperm Oil | 6.4% Extract |
| Control Sample (Natural Fat Content) of the Non-Liquored Leather | 1.3% Extract |

All the above-listed values refer to anhydrous leather.

Example 5 indicates the formation of an extremely strong bond between the impregnating agent according to the invention and the leather. The impregnating agent can practically not be extracted with dichloromethane. This is shown by the fact that the control sample had a 1.3% extract, while the leather sample impregnated according to the invention had a 1.5% extract. The leather sample impregnated with the sulfated sperm oil had a 6.4% extract, which is more than 4 times greater than the result according to the invention.

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

We claim:

1. A process for manufacturing waterproof leather or skins, which comprises impregnating said leather or skins with an effective water-proofing amount of an aqueous fat-liquoring emulsion of a mixture of (A) an acid ester of citric acid with a fatty alcohol having 12 to 22 carbon atoms, and (B) an organic alcohol solvent for said ester of citric acid which is totally or partially soluble in water and which has a boiling point above 100°C., the ratio of component (A) to component (B) being between 9 : 1 and 1 : 9.

2. The process of claim 1, wherein component (A) is an acid ester of citric acid with a fatty alcohol selected from the group consisting of a straight-chain unsaturated fatty alcohol having 12 to 18 carbon atoms, a branched-chain saturated fatty alcohol having 12 to 18 carbon atoms, and a branched-chain unsaturated fatty alcohol having 12 to 18 carbon atoms.

3. A process according to claim 1 wherein the organic alcohol is selected from the group consisting of the alkanediols having 2 to 6 carbon atoms, the monoalkyl ethers of alkanediols having 2 to 6 carbon atoms with lower alkanols having 1 to 6 carbon atoms, and the cycloalkylether alcohols having 4 to 6 carbon atoms.

4. The process of claim 1, wherein component (B) is a monoalkyl ether of an alkanediol having 2 to 6 carbon atoms with a lower alkanol having 1 to 6 carbon atoms.

5. The process of claim 1, wherein component (B) is a cycloalkylether alcohol having 4 to 6 carbon atoms.

6. The process of claim 1, wherein component (A) is an acid ester of citric acid selected from the group consisting of citric acid-monooleyl ester, citric acid-monoalkenyl ester having 12 to 18 carbon atoms and citric acid-monoisooctadecyl ester.

7. The process of claim 1, wherein component (B) is an organic solvent selected from the group consisting of ethanediol, 1,2-propanediol, 1,3-propanediol, 1,3-butanediol, 1,4-butanediol, 1,5-pentanediol, 1,6-hexanediol, 2-methyl-2-propyl-1,3-propanediol and 2-methyl-2,4-pentanediol, glycol monomethyl ether, glycol monoethyl ether, glycol monobutyl ether, 1,2-propanediol monobutyl ether, tetrahydrofurfuryl alcohol and the mixtures thereof.

8. The process of claim 1, wherein component (B) is the tetrahydrofurfuryl alcohol.

9. The process of claim 1, wherein the ratio of component (A) to component (B) ranges from 1 : 1 to 2 : 1.

10. The process of claim 1, wherein said fat-liquoring emulsion contains an amount of ammonia which is not sufficient for the complete neutralization of the acid ester of citric acid.

11. The process of claim 1, wherein said leather is a chrome tanned leather.

12. A fat-liquoring aqueous preparation for waterproofing leather or skins consisting essentially of an aqueous emulsion of a mixture of (A) an acid ester of citric acid with a fatty alcohol having 12 to 22 carbon atoms and (B) and organic alcohol solvent for said acid ester of citric acid which is totally or partially soluble in water and which has a boiling point of over 100°C., the amount of said acid ester of citric acid being from 3% to 8% by weight of the fat-liquoring aqueous preparation, and the ratio of component (A) to component (B) being from 9 : 1 to 1 : 9.

13. The process of claim 1, wherein component (B) is an alkanediol having 2 to 6 carbon atoms.

* * * * *